US006013110A

United States Patent [19]

Gee

[11] Patent Number: 6,013,110

[45] Date of Patent: Jan. 11, 2000

[54] METHODS OF PATTERN DYEING HAIR WITH A HAIR DYE RETAINING ROLLER

[76] Inventor: Jenipher T. Gee, 1759 E. 77th St., Indianapolis, Ind. 46240

[21] Appl. No.: 09/185,037

[22] Filed: Nov. 3, 1998

[51] Int. Cl.[7] ..... A61K 7/13

[52] U.S. Cl. ..... 8/405; 8/405; 8/487; 132/208

[58] Field of Search ..... 8/405, 487; 132/208, 132/221, 320; D28/20, 7

[56] References Cited

U.S. PATENT DOCUMENTS

| | | | |
|---|---|---|---|
| D. 113,690 | 3/1939 | Tresenberg | 132/320 |
| D. 246,804 | 12/1977 | Kesler | D28/7 |
| D. 252,219 | 6/1979 | Peeples | D28/7 |
| D. 257,447 | 10/1980 | Kesler | D28/7 |
| D. 345,816 | 4/1994 | Moore et al. | D28/7 |
| D. 352,130 | 11/1994 | Zierhut | D28/7 |
| D. 363,377 | 10/1995 | Koptis | D28/7 |
| 3,833,008 | 9/1974 | Blackett et al. | 132/85 |
| 4,209,027 | 6/1980 | Morganroth | 132/212 |
| 4,211,247 | 7/1980 | Morganroth | 132/270 |
| 4,602,651 | 7/1986 | Roppatte, Jr. | 132/320 |
| 4,830,030 | 5/1989 | Busch et al. | 132/212 |
| 4,880,019 | 11/1989 | Roubo | 132/270 |
| 5,433,225 | 7/1995 | Ligget et al. | 132/208 |
| 5,588,449 | 12/1996 | Falcon | 132/208 |
| 5,706,839 | 1/1998 | Patti | 132/277 |
| 5,713,095 | 2/1998 | Wakat | 15/230 |
| 5,755,241 | 5/1998 | Cheung | 132/112 |
| 5,778,902 | 7/1998 | Nagy | 132/200 |
| 5,799,669 | 9/1998 | Briggs | 132/208 |
| 5,845,653 | 12/1998 | Abercrombie | 132/208 |
| 5,860,431 | 1/1999 | Abercrombie | 132/208 |

OTHER PUBLICATIONS

Color Design Sponges for A Touch of Color, The Wella Corporation, Montvale N.J., 07645, UPC 98540 (product), 1997.

*Primary Examiner*—Caroline D. Liott

*Attorney, Agent, or Firm*—Ice Miller Donadio & Ryan; Jay G. Taylor; James D. Wood

[57] ABSTRACT

The present invention provides a method for quickly and easily applying hair dye to the hair of a person. The method allows the creation of simple patterns and designs or increasingly complex patterns and designs of a highly intricate and detailed fashion. The method provides a hair dye applicator which can be rolled or daubed on the hair of a person to create highly unique and personalized patterns. By providing applicators of various shapes and patterns, and a tray to hold hair dyes of different colors, designs of increasing intricacy and complexity can be realized.

6 Claims, 6 Drawing Sheets

METHODS OF PATTERN DYEING HAIR WITH A HAIR DYE RETAINING ROLLER

FIELD OF THE INVENTION

This invention relates to hairstyling, and, in particular, to methods for creating designs in a persons hair from different colored hair dyes.

BACKGROUND OF THE INVENTION

Today's society places increasing value on the ability of a person to have stylish hair. One of the principle means of achieving a stylish hairstyle is to have one's hair display a variety of colors and patterns. However, implements used to apply hair dyes often limit the patterns in which the hair dye can be applied. For example, it is known to apply hair dye to hair using a brush having bristles. However, this application technique causes the hair to be displaced by the bristles as they move along the surface of the hair. Accordingly, this system does not permit, for example, straight lines to be created in a person's hair, particularly when the straight line is not parallel with the hair strands. This shortcoming precludes the ability to form intricate, attractive and unique hairstyles using differently colored hair dyes.

Moreover, existing techniques for applying hair dye require the use of applicators requiring a high level of skill. Moreover, existing applicators frequently require significant time to create the desired pattern and clean up after use, which adversely impacts a professional hairstylists ability to make efficient use of time.

OBJECTS OF THE INVENTION

One object of the invention is to provide a fast method for applying hair dye.

Another object of the invention is to provide a method for applying hair dye that minimizes cleanup time and effort.

Another object of the invention is to provide a method for applying hair dye allows patterns to be applied to hair, that are non-parallel with the strands of hair.

Another object of the invention is to provide a tray to facilitate application of multiple hair dye colors to a person's hair.

SUMMARY OF THE INVENTION

The present invention provides a method for quickly and easily applying hair dye to the hair of a person. The method allows the creation of simple patterns and designs or increasingly complex patterns and designs of a highly intricate and detailed fashion. The method provides a hair dye applicator which can be rolled or daubed on the hair of a person to create highly unique and personalized patterns. By providing applicators of various shapes and patterns, and a tray to hold hair dyes of different colors, designs of increasing intricacy and complexity can be realized.

The present invention offers significant benefits over the prior art which are summarized as follows:

- Provides a method which reduces the skill level needed to create intricate designs.
- Significantly reduces effort needed to cleanup tools.
- Provides a method which allows a virtually unlimited variety of designs which are not limited by concern that hair will be displaced in the dyeing process, thereby destroying the design.
- Provides a method which reduces the time needed to create intricate designs.

- Provides a tray which facilitates the application of a plurality of hair dyes to a person's hair.
- Provides a method for simultaneously applying a plurality of hair dye colors in a plurality of patterns.
- Provides a method which can be performed inexpensively.

DETAILED DESCRIPTION

Figure 1:
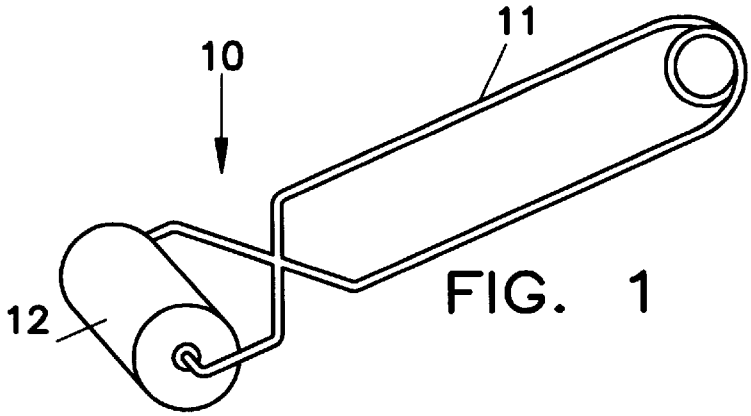
FIG. 1 shows a hair dye applicator.
Figure 2:
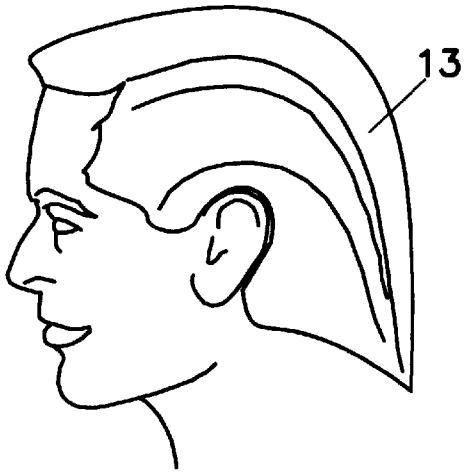
FIG. 2 shows a side view of a person with hair.

The invention provides a method for applying hair dye to the hair of a person. In one exemplary embodiment, applicator 10, as shown in FIG. 1, is provided which has handle 11 and hair dye retaining roller 12 affixed thereto. Hair dye retaining roller 12 may be formed from any suitable material capable of retaining a hair dye, such as foam rubber. Additionally, roller 12 may be formed in different sizes to facilitate the creation OF the desired design. Roller 12 of applicator 10 may be placed in a first colored hair dye to absorb the hair dye and thereby retain it on roller 12. Roller 12 can then be moved to contact hair 13 of a person. The hair stylist may then move hair dye retaining roller 12 along hair 13 of the person in a pattern such that the first colored hair dye is applied to hair 13 of the person consistent with the pattern with which hair dye retaining roller 12 has been moved along hair 13 of the person.

Figure 3:
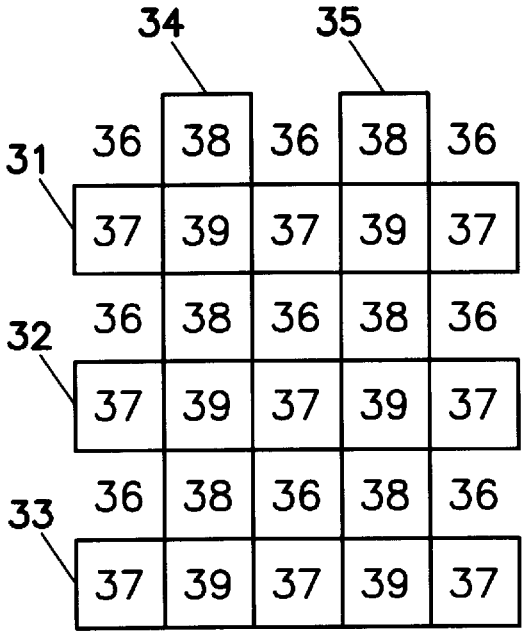
FIG. 3 shows a pattern using two different colored hair dyes.

For example, referring to FIG. 3, a hair stylist may apply two different colors of hair dye to a person's hair. In FIG. 3, three horizontal patterns 31, 32, and 33 are shown, which may be made from a first hair color dye. Vertical patterns 34 and 35 may be made from a second hair color dye. Using this pattern, four different colors of hair will be realized. Specifically, the natural (or at least initial) color of the person's hair consistent with those areas, such as 36, where no hair color is applied, areas 37 where only the first hair dye is applied, areas 38 where only the second hair dye is applied, and areas 39 where both hair dyes are applied. This method provides a unique and distinctive gingham pattern certain to elevate subject of this distinctive and fashionable hair style to the upper echelon of social stature.

Those of skill in the art will appreciate that the foregoing procedure can be applied to hair strands 13 that are in a generally parallel orientation, and that the application of hair dye may be in a direction generally non-parallel, or even perpendicular, with hair strands 13. This result is accomplished via the rolling action of roller 12 which, unlike prior art brush bristles or other hair dye color application devices, will not move hair strands 13 out of their parallel alignment.

Figure 4:
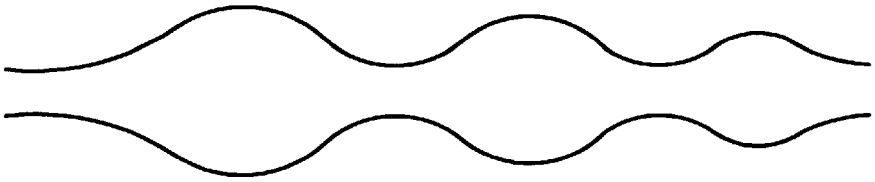
FIG. 4 shows a pattern of a line with varying width.
Figure 5A:
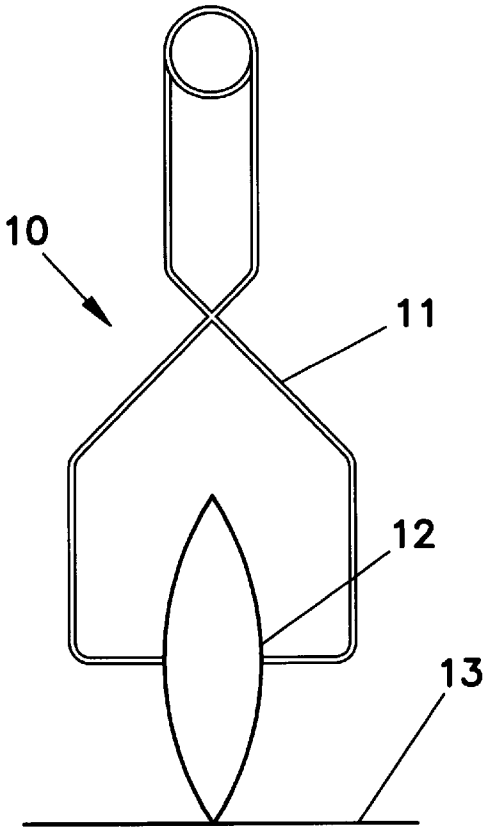
FIG. 5*a* and FIG. 5*b* show an alternative embodiment of a hair dye applicator.
Figure 5B:
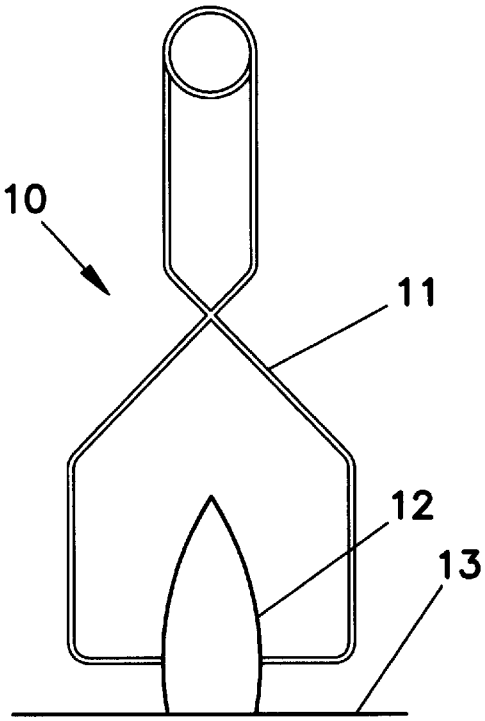
Figure 6A:
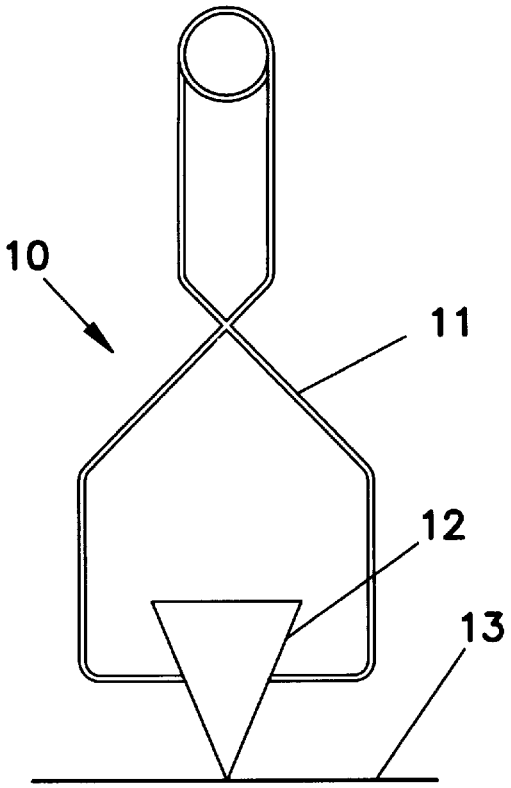
FIG. 6*a,* FIG. 6*b,* and FIG. 6*c* show an alternative embodiment of a hair dye applicator with the roller in different positions.
Figure 6B:
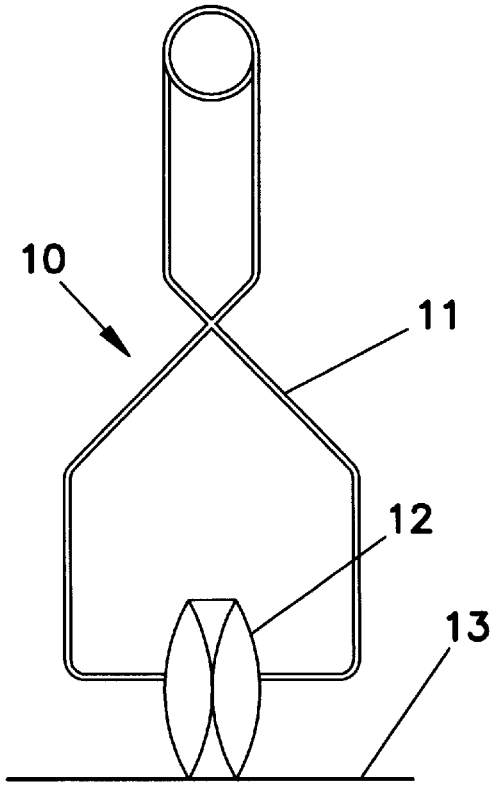
Figure 6C:
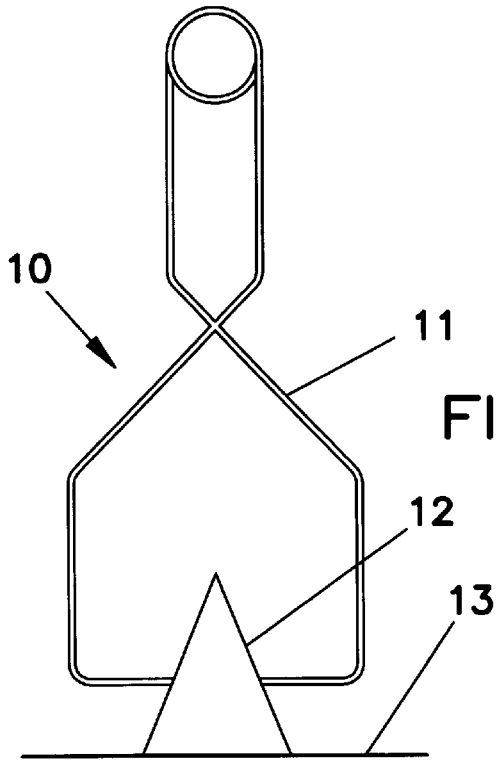

The method of the present invention also permits lines of varying widths to be formed in a person's hair, such as the one shown FIG. 4. This may be accomplished in any number of different ways. For example, referring to FIG. 1, roller 12 may be held at an angle to hair strand 13 so that only corner 14 of roller 12 contacts hair strand 13. As roller 12 is rolled along hair strand 13, a varying, intermittently light and then heavy pressure may be applied when forcing roller 12 over hair strand 13. Due to the flexible nature of roller 12, this causes a varying width of roller 12 to come into contact with hair strand 13 as the pressure is varied. In another embodiment, shown in FIG. 5*a* and FIG. 5*b,* roller 12 is shaped to ease the creation of a pattern of varying widths. FIG. 5*a* shows shaped roller 12 with a light pressure being applied by shaped roller 12 to hair strand 13, resulting in a relatively narrow width of shaped roller 12 contacting hair strand 13, creating a narrow pattern. By increasing the pressure of shaped roller 12 on hair strand 13 as shaped roller 12 is forced over hair strand 13 as shown in FIG. 5*b,* a wide area of shaped roller 12 is in contact with hair strand 13 resulting in a wide pattern of hair dye being applied to hair strand 13. Alternatively, roller 12 may be constructed so that its width varies along its circumference. This embodiment is shown in FIG. 6*a* where narrow portion 14 of roller 12 is contacting hair strand 13, FIG. 6*b* where intermediate portion 15 of roller 12 is contacting hair strand 13, and FIG. 6*c* where wide portion 16 of roller 12 is contacting hair strand 13.

Figure 7:
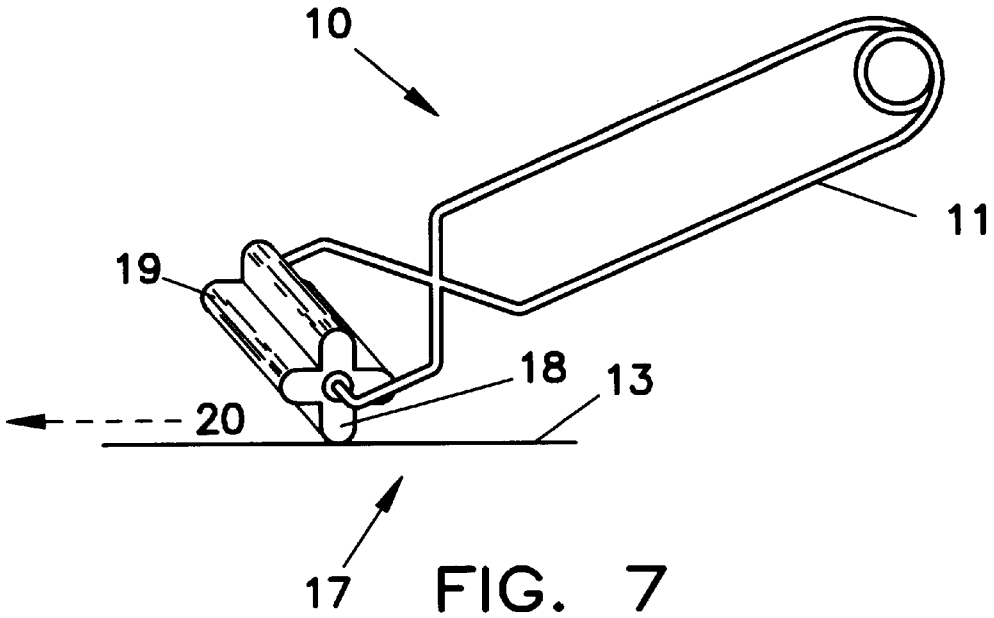
FIG. 7 shows an alternative embodiment of a hair dye applicator.
Figure 8:
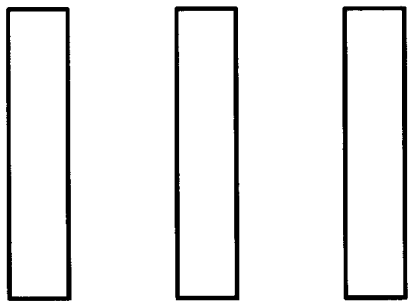
FIG. 8 shows a sequential, non-contiguous pattern of hair dye.

In yet another embodiment, a sequential, non contiguous pattern is created. FIG. 7 shows roller 12 with a plurality of contact ridges 17. As roller 12 is forced over hair strand 13 in the direction of arrow 20, first contact ridge 18 will contact hair strand 13 thereby depositing hair dye on hair strand 13. As roller 12 continues to be forced over hair strand 13, second contact ridge 19 contacts hair strand 13 thereby depositing hair dye on hair strand 13 at some distance from the hair dye deposited by contact ridge 18. This results in the pattern shown in FIG. 8 where areas 71 have hair dye and areas 72 are non-hair dye colored hair. The present invention includes within its scope the use of other rollers, such as, but not limited to, rollers of irregular width and rollers having a plurality of shapes comprising the contact ridges.

Figure 9:
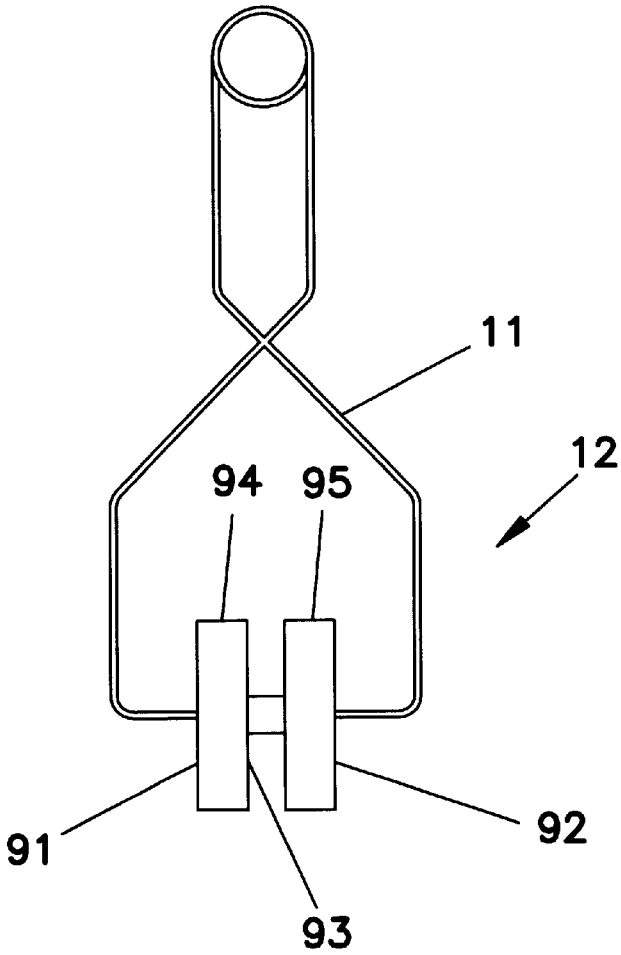
FIG. 9 shows an alternative embodiment of a hair dye applicator.
Figure 10A:
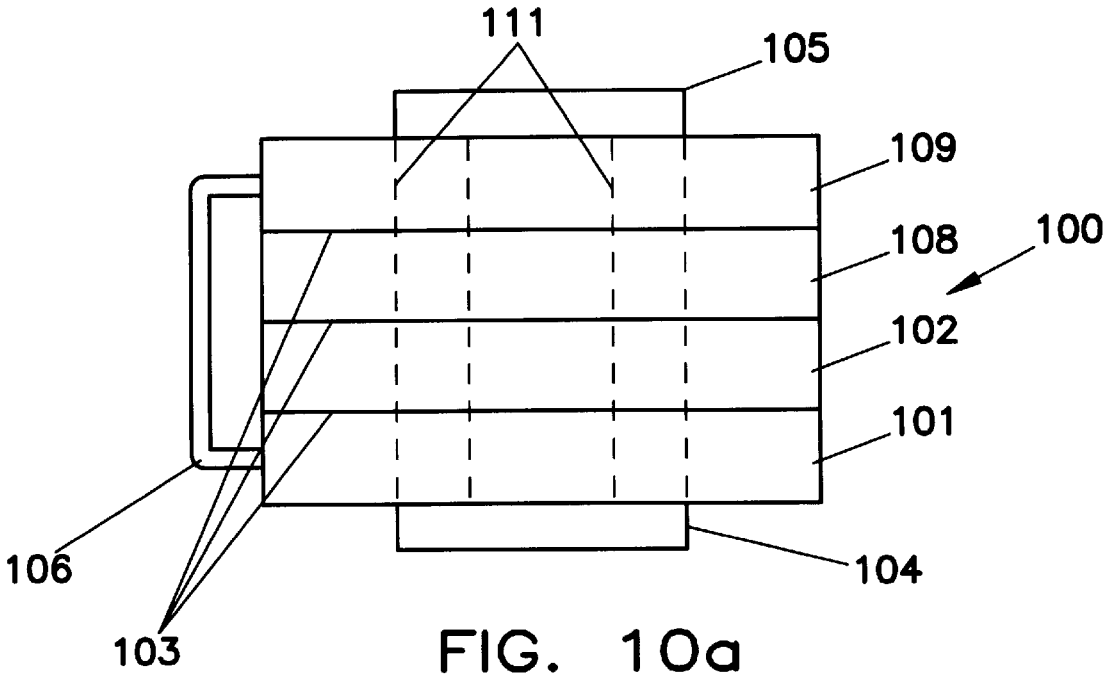
FIG. 10*a,* FIG. 10*b,* and FIG. 10*c* show a top view, a side view, and a front view respectively of a tray for use with a hair dye applicator.
Figure 10B:
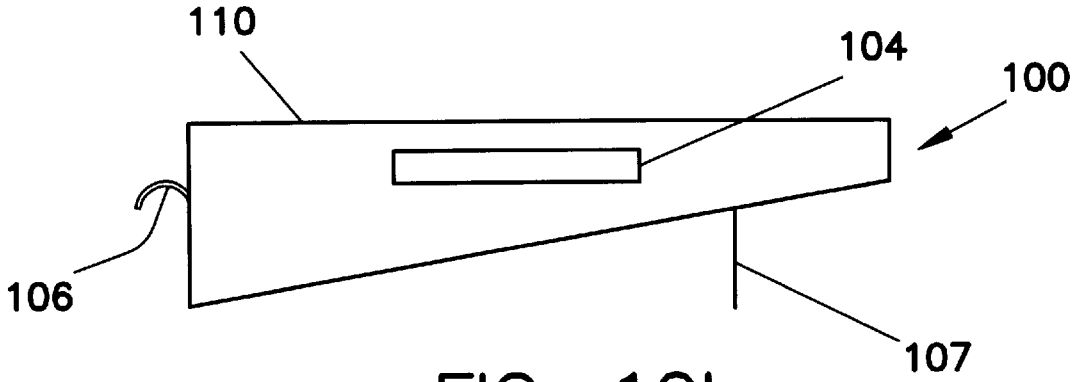
Figure 10C:
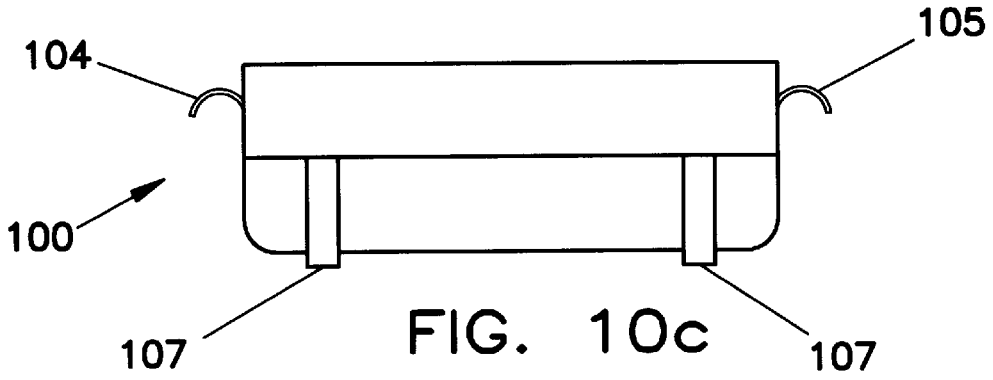

In another embodiment, hair dye of two or more colors is simultaneously applied to a person's hair. In the embodiment of FIG. 9, roller 12 comprises sub-roller 91, sub-roller 92, and spacer 93. FIG. 10*a,* FIG. 10*b,* and FIG. 10*c* show a top view, side view, and a front view respectively of tray 100 which can be used in conjunction with the embodiment of roller 12 shown in FIG. 9. Tray 100 comprises longitudinally extending basins 101, 102, 108, and 109 of about six inches in length, separated by walls 103. FIG. 10*b* shows that in a preferred embodiment, basins 101, 102, 108, and 109 have a shallow end of about one-half inch depth and a deep end of about two inch depth, basins 101, 102, 108, and 109 being tapered from the shallow to the deep end. Ridges 111 are provided in each of basins 101, 102, 108, and 109. Top edge 110 of tray 100 is maintained in a substantially horizontal position when tray 100 is resting on a horizontal surface, by support 107. Closed handles 104 and 105 are provided for comfortably and easily transporting tray 100 between stations while hair dye is contained within one or more of basins 101, 102, 108 and or 109. Open handle 106 is provided for ease of transportation when no dye is present. Open handle 106 also provides a convenient means for hanging tray 100 in a optimal position for drying. Walls 103 are of a height sufficient to maintain separate, hair dye placed within longitudinally extending basins 101 102, 108, and 109, while allowing sub-rollers 91 and 92 to contact hair dye placed within longitudinally extending basin 101 102, 108, or 109. This is accomplished by ensuring that the height of walls 103 is less than the distance from contact edge 94 and 95 of sub-rollers 91 and 92 respectively to spacer 93.

Referring to FIG. 9 and FIG. 10*a,* which is an end view of tray 100, the method of applying two colors simultaneously can be explained. Hair dye is placed within at least two adjacent longitudinally extending basins 101, 102, 108 or 109 such that the shallow end of basins 101, 102, 108, and 109 do not have hair dye while the deep end of at least two adjacent basins 101, 102, 108, and or 109 have hair dye. The hair dye will be preferentially located at the deep end of basins 101, 102, 108, and 109 due to the taper of basins 101, 102, 108, and 109 and support 107. Roller 12 is then placed into tray 100 such that sub-roller 91 is in one of longitudinally extending basins 101, 102, 108, or 109 having dye in it. Sub-roller 92 is simultaneously placed in the adjacent longitudinally extending basin 101, 102, 108, or 109 having dye in it, such that spacer 93 is located on or above walls 103. Roller 12 is then forced along the length of tray 100 such that hair dye is absorbed into sub-rollers 91 and 92 respectively. The shallow end of basin 101, 102, 108, and or 109 can be used to force excess hair dye out of sub-rollers 91 and or 92. This is aided by ridges 111. Roller 12 is then placed in contact with hair strand 13, and forced over hair strand 13 such that hair dye absorbed into sub-rollers 91 and 92 is deposited onto hair strand 13. It will be obvious to those skilled in the art that sub-rollers 91 and 92 may be of differing patterns and styles. Additionally, although the above embodiment of roller 12 comprises two sub-rollers, roller 12 may comprise more sub-rollers for artistic effect, the use of such rollers being within the scope of the present invention.

Figure 11:
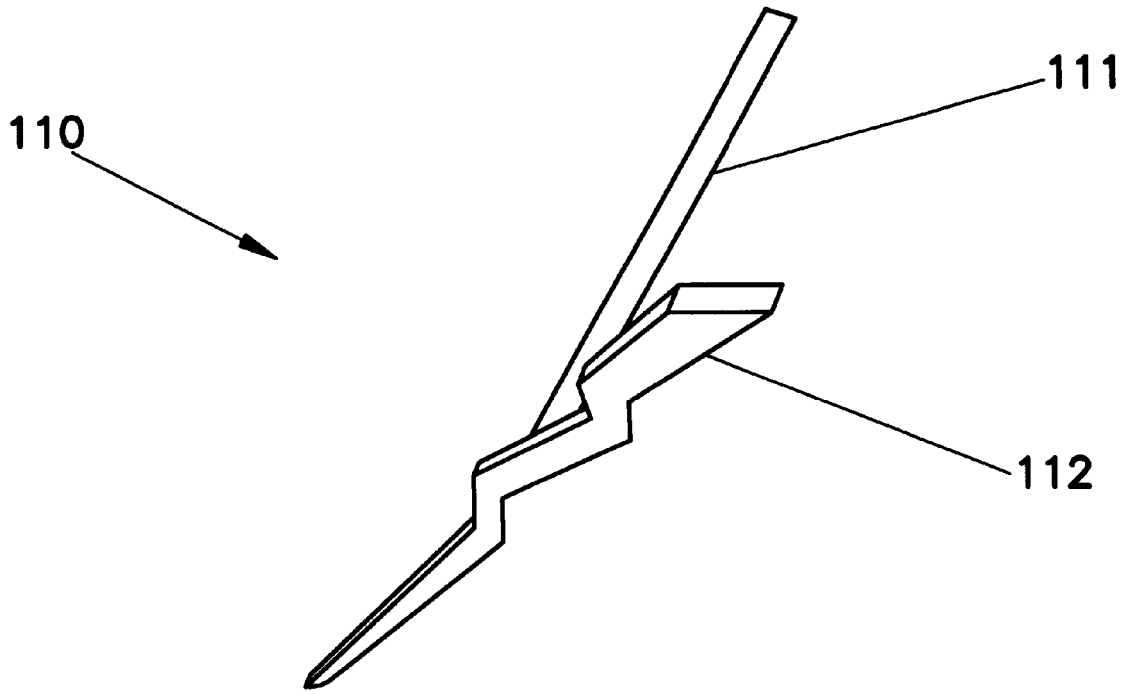
FIG. 11 is an alternative embodiment of a hair dye applicator.

The invention in another embodiment provides applicator 110, as shown in FIG. 11, applicator 110 having handle 111 and hair dye retaining surface 112 affixed thereto. Hair dye retaining surface 1 12 may be formed from any suitable material capable of retaining hair dye, such as foam rubber. Retaining surface 112 of applicator 110 may be placed in a colored hair dye to absorb hair dye and thereby retain it on retaining surface 112. Retaining surface 112 can then be moved to contact hair 13 of person such that hair dye is applied to hair 13 of person in the pattern of retaining surface 112. While the embodiment of retaining surface 112 shown in FIG. 11 is a lightening bolt, other discrete shapes such as that of a triangle, circle, star, crescent moon, lightening bolt, fire flame or butterfly are within the scope of this invention. In one embodiment, retaining surface 1 12 is detachable from handle 111 such that a plurality of retaining surfaces 112 comprising a plurality of shapes may be used with the same handle 111.

Although a specific embodiment of the invention has been disclosed with reference to a preferred embodiment, it will be understood by those of skill in the art that changes in form and details may be made without departing from the spirit and scope of the invention. The present invention is in no way limited to the details disclosed herein. Accordingly, the present invention is to be defined and limited solely by the scope of the claims.

What is claimed is:

1. A method for applying hair dye to the hair of a person, comprising the steps of:

(A) providing an applicator, the applicator having a handle and a hair dye retaining roller affixed thereto, the hair dye retaining roller retaining a first colored hair dye;

(B) contacting the first colored hair dye retaining roller to the hair of the person;

(C) moving the hair dye retaining roller along the hair of the person in a pattern; such that the first colored hair dye is applied to the hair of the person consistent with the pattern with which the hair dye retaining roller has been moved along the hair of the person;

(D) providing an applicator, the applicator having a handle and a hair dye retaining roller affixed thereto, the hair dye retaining roller retaining a second colored hair dye of a color different than the color of the first hair dye;

(E) contacting the second colored hair dye retaining roller to the hair of the person;

(F) moving the second colored hair dye retaining roller along the hair of the person in a pattern which intersects the direction of movement of the hair dye retaining roller containing the first colored hair dye;

such that the second colored hair dye is applied to the hair of the person consistent with the pattern with which the hair dye retaining roller has been moved along the hair of the person.

2. The method of claim 1 wherein:

(A) the hair strands of the person are in a parallel orientation; and (B) the direction of movement of the hair dye retaining roller containing the first colored hair dye is non-parallel with the hair strands.

3. The method of claim 2 wherein the direction of movement of the hair dye retaining roller containing the first colored hair dye is perpendicular with the hair strands.

4. A method for applying hair dye to the hair of a person, comprising the steps of:

(A) providing an applicator, the applicator having a handle and a hair dye retaining roller affixed thereto, the hair dye retaining roller retaining a colored hair dye;

(B) contacting the colored hair dye retaining roller to the hair of the person;

(C) moving the edge of the hair dye retaining roller along the hair of the person in a pattern; such that the colored hair dye is applied to the hair of the person consistent with the pattern with which the hair dye retaining roller has been moved along the hair of the person, wherein the pattern in the hair of the colored hair dye is a line having a varying width, wherein the pattern of varying width is created (i) by varying the pressure applied to the roller against the hair of a person, or (ii) with a roller having a circumference of varying widths.

5. The method of claim 4 wherein the pattern of varying width is created by varying the pressure applied to the roller against the hair of the person.

6. The method of claim 4 wherein the pattern of varying width is created with a roller having a circumference of varying widths.

* * * * *